US007513611B2

(12) United States Patent
Manzone et al.

(10) Patent No.: US 7,513,611 B2
(45) **Date of Patent: *Apr. 7, 2009**

(54) STORAGE AND INK REFILLING STATION FOR A CARTRIDGE OF A PRINTHEAD

(75) Inventors: Mario Manzone, Ivrea (IT); Paolo Poma, Ivrea (IT)

(73) Assignee: Telecom Italia S.p.A., Milan (IT)

( * ) Notice: Subject to any disclaimer, the term of this patent is extended or adjusted under 35 U.S.C. 154(b) by 61 days.

This patent is subject to a terminal disclaimer.

(21) Appl. No.: 10/553,413

(22) PCT Filed: Apr. 8, 2004

(86) PCT No.: PCT/IT2004/000192

§ 371 (c)(1),
(2), (4) Date: Sep. 20, 2006

(87) PCT Pub. No.: WO2004/091919

PCT Pub. Date: Oct. 28, 2004

(65) Prior Publication Data

US 2007/0171264 A1 Jul. 26, 2007

(30) Foreign Application Priority Data

Apr. 17, 2003 (IT) ..... T02003A000303

(51) Int. Cl.
*B41J 2/175* (2006.01)

(52) U.S. Cl. ..... 347/85; 118/268; 222/577; 347/7; 347/86; 401/119; 422/58; 47/17; 47/65.5; 47/79

(58) Field of Classification Search ..... None
See application file for complete search history.

(56) References Cited

U.S. PATENT DOCUMENTS 2,620,499 A * 12/1952 Dressel ..... 401/119

(Continued)

FOREIGN PATENT DOCUMENTS

EP 0 322 131 A1 6/1989

(Continued)

OTHER PUBLICATIONS

International Search Report dated Jul. 21, 2004, issued in PCT/IT2004/000192.

*Primary Examiner*—Luu Matthew
*Assistant Examiner*—John P Zimmermann
(74) *Attorney, Agent, or Firm*—Venable LLP; Robert Kinberg; Steven J. Schwarz

(57) ABSTRACT

A station for storing and refilling a cartridge of a printhead has a container in which a seat is arranged for accommodating the cartridge to be refilled; the ink for refilling being contained in a collection chamber located in the bottom part of the container. The collection chamber communicates freely with a back-flow compartment located at the top, surrounding the housing and in free communication with the chamber. The feeding is effected by means of a capillary element contained inside an impermeable sheath extending vertically into the collection chamber and arranged centrally in a symmetrical position with respect to the base of the container. The capillary element penetrates into the housing in contact with the sponge of the cartridge to transfer the ink through capillarity. Feeding takes place solely and exclusively with the container in the vertical position whereas in any other position the ink flows into the back-flow compartment and the capillary element is no longer lapped against by the ink. In this way, any dripping and/or leakage of ink through the capillary element is avoided.

10 Claims, 4 Drawing Sheets

U.S. PATENT DOCUMENTS

| | | | | |
|---|---|---|---|---|
| 2,737,927 | A * | 3/1956 | Rhoades | 401/119 |
| 4,614,163 | A * | 9/1986 | Hetzer et al. | 118/268 |
| 5,482,191 | A * | 1/1996 | Kaufmann | 222/577 |
| 5,971,532 | A | 10/1999 | Toda | |
| 6,048,054 | A | 4/2000 | Ando et al. | |
| 6,338,552 | B1 | 1/2002 | Sato et al. | |
| 6,766,817 | B2 * | 7/2004 | da Silva | 137/1 |
| 7,273,273 | B2 * | 9/2007 | Calvini et al. | 347/86 |

FOREIGN PATENT DOCUMENTS

| | | |
|---|---|---|
| EP | 0 605 183 A2 | 7/1994 |
| EP | 1 199 178 A 1 | 4/2002 |

* cited by examiner

STORAGE AND INK REFILLING STATION FOR A CARTRIDGE OF A PRINTHEAD

CROSS REFERENCE TO RELATED APPLICATIONS

This application is a national phase application based on PCT/IT2004/000192, filed Apr. 8, 2004, which claims the priority of Italian Application No. TO2003A000303, filed Apr. 17, 2003, the content of which is incorporated herein by reference.

1. Field of the Invention

The present invention relates to a storage and ink refilling station for a cartridge of a printhead, and more particularly to a refilling station perfected to prevent ink from leaking.

2. Brief Description of the State of the Art

A similar device is known from European patent No. 605.183 for storing at least one cartridge of an ink jet printhead and for keeping it refilled with ink; this device comprises a container provided with a first chamber suitable for accommodating a cartridge refillable with ink, which can be inserted through an upper aperture, and a second chamber arranged below the first chamber, and separated therefrom by a horizontal wall and suitable for containing the ink with which to refill the cartridge in the first chamber; a cylindrical capillary element is borne by the horizontal wall and has a first end immersed in the ink in the second chamber and a second end protruding into the first chamber and suitable for insertion in the cartridge in contact with a sponge for transferring the ink through capillarity from the second chamber to the cartridge.

This device has the drawback that when the container is turned over on a side or turned upside down, during transport for instance, the capillary element remains in contact with the ink and continues transferring the ink to the cartridge not only through capillarity but also on account of the head of ink above the capillary element, therefore causing an overfilling of the cartridge with, as a result, ink flowing out of the cartridge. This drawback is most apparent in cases where the cartridge is not in the first chamber, in which case, ink would drip in abundance inside the first chamber.

SUMMARY OF THE INVENTION

The main object therefore of this invention is that of producing a storing and ink refilling station of a cartridge of a printhead, without the drawback mentioned above.

Another object of this invention is to produce a perfected storing and ink refilling station, in which the cartridge is refilled with ink when the station is in the vertical position, while refilling with ink is interrupted when the storage station is in any other position other than the vertical, in this way avoiding ink dripping or running through the capillary element.

Therefore in accordance with the planned objects of this invention, a storage and ink refilling station for a cartridge of a printhead, comprising a container (4) suitable for containing a predetermined volume of ink (17) in a collection chamber (18), adjacent to a bottom wall (6), serving as a support platform (6*a*) of the container (4) on a horizontal plane (9), for defining a vertical operating position of the container (4), which also has a housing (10), attached to a top wall (7) of the container (4) and suitable for accommodating the cartridge (2), inserted through an aperture (12) in the top wall (7), the station (1) also comprising refilling means (24, 26), at least partially immersed in the predetermined quantity of ink (17), when the container (4) is in the vertical operating position, and cooperating with the cartridge for transferring the ink from the collection chamber (18) to the cartridge (2), characterized as defined in the main claim.

This and other characteristics of the invention will appear more clearly from the following description of a preferred embodiment, provided by way of non-restricting example, with reference to the figures in the accompanying drawings.

DETAILED DESCRIPTION OF A PREFERRED EMBODIMENT

Figure 1:
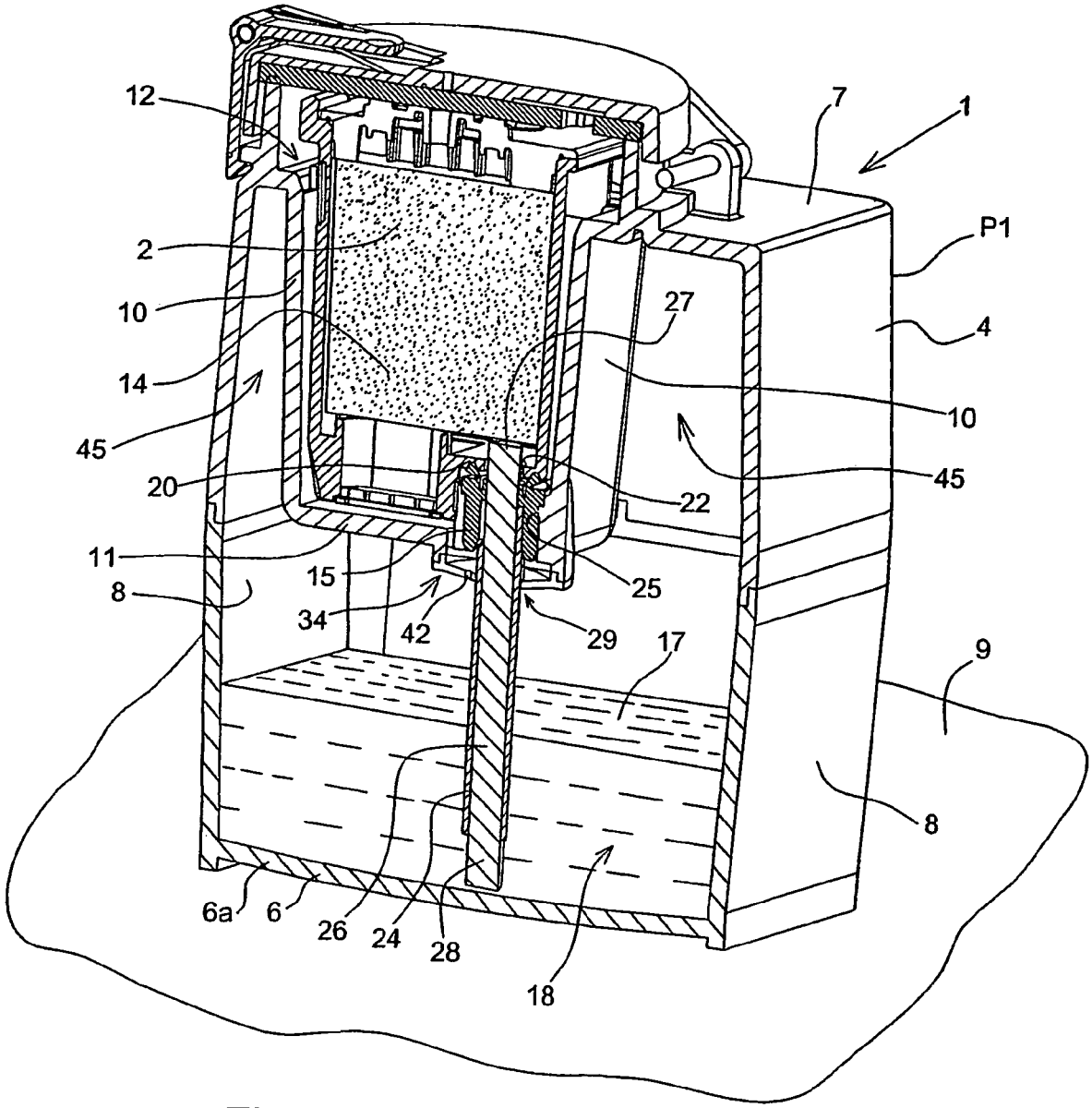
FIG. 1 is a cross-sectioned, perspective view of the storing and refilling station, according to the invention.

The station 1, in accordance with the present invention, for storing and refilling a cartridge 2 of a printhead, depicted in FIG. 1, comprises a container 4 consisting of a bottom wall 6, a top wall 7, substantially parallel to the bottom wall 6, and at least one side wall 8, integrally attached to the other two walls 6 and 7.

The bottom wall 6 acts as the support platform of the container 4 on a horizontal plane 9, for setting the container in a vertical operating position P1, in order to refill the cartridge 2 with ink, as will be described in greater detail in the following.

The container 4 can indifferently be made in a cylindrical shape, or as a parallelepiped, or a right-angled prism; in the first case, the side wall 8 will be made in a single, continuous piece, substantially shaped as a cylinder trunk; in the second case the side wall 8 will be made of various flat walls, four for instance, 8*a*, 8*b*, 8*c* and 8*d*, joined together and to the walls 6 and 7.

A substantially parallelepiped shape housing 10 is arranged inside the container 4, and is integrally attached to the top wall 7, in such a way as to extend inside the container 4 in the direction of the bottom wall 6.

The housing 10 is closed at the bottom by a bottom wall 11 and is configured to house the cartridge 2 for a known type printer, not shown in any of the drawings, which cartridge 2 is inserted into the housing 10 through an aperture 12 made in the top wall 7 of the container 4.

Figure 2:
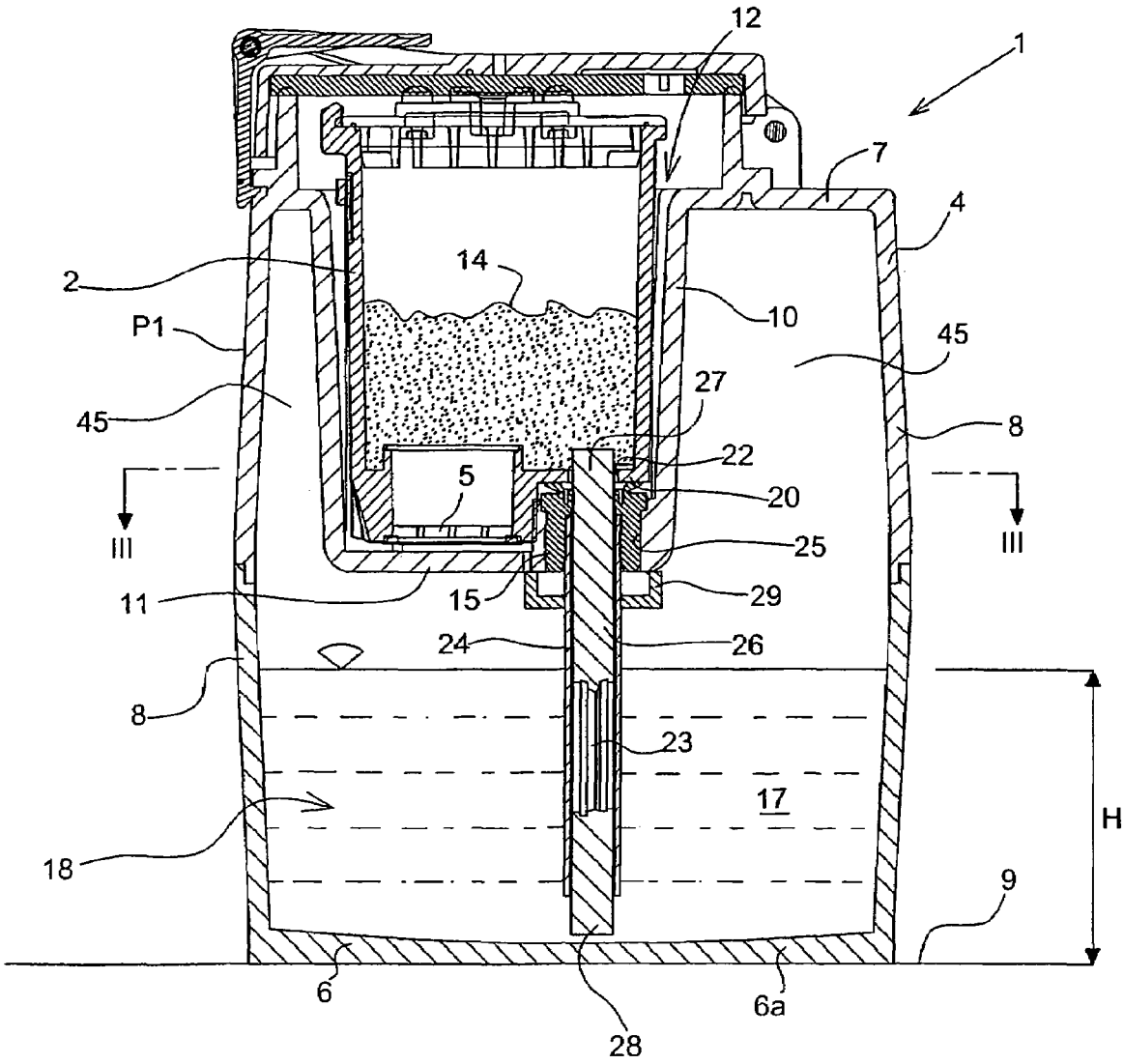
FIG. 2 is a vertical cross-section, along the median line of the station of FIG. 1.
Figure 3:
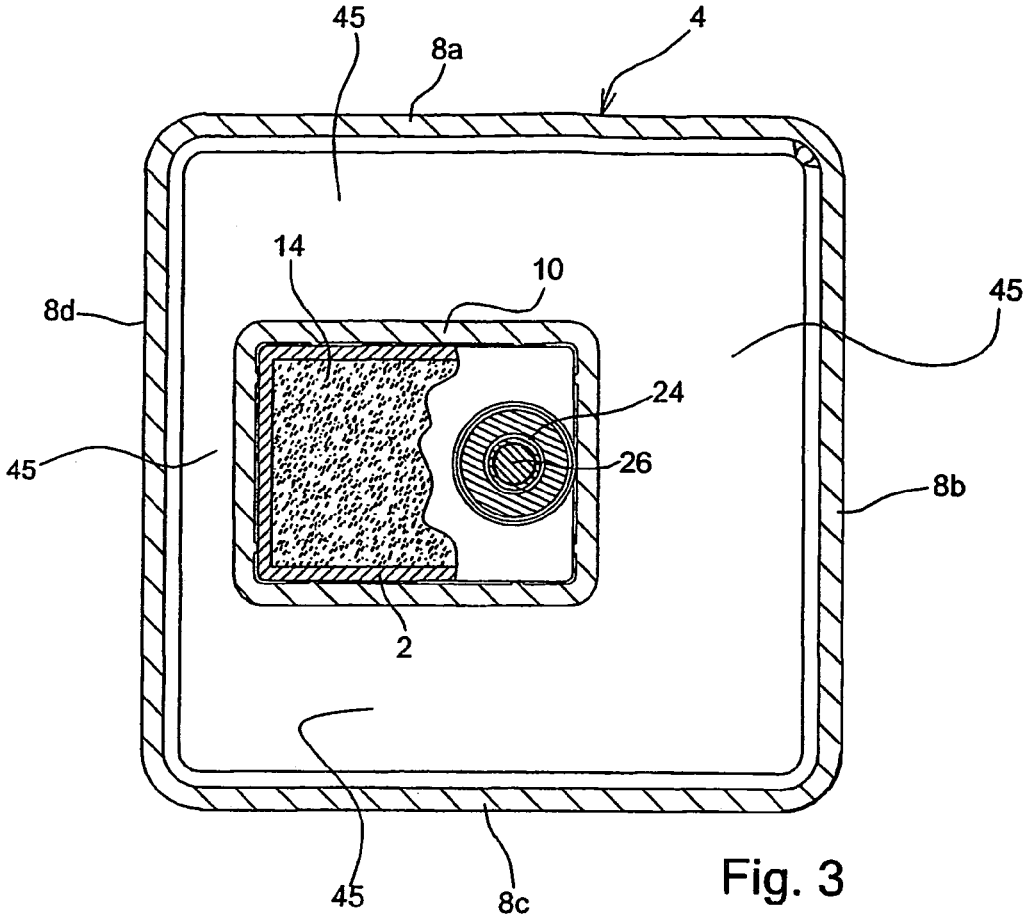
FIG. 3 is a transversal view, cross-sectioned along the line III-III of FIG. 2.

The cartridge 2, in particular, according to a non-restrictive version, can be of the type in which an ink jet printhead 5 is integrated with the cartridge 2, as is shown for instance in FIG. 2 as a non-restrictive example; alternatively, the cartridge 2 can be without a printhead and in this case, can be inserted in an appropriate seat in a printer having its own printhead. Both the mentioned types of cartridge are well known to those acquainted with the sector art, and will not therefore be examined in detail in this description.

The cartridge 2 contains a spongy body 14 normally impregnated with ink at the time of manufacture. When the cartridge 2, at the end of a printing cycle, has finished its original ink, it can be refilled repeatedly with ink by means of the station 1.

The ink 17 is normally contained in a collection chamber 18, arranged in the bottom part of the container 4, and adjacent to the bottom wall 6.

The vertical position P1 of the container 4, shown in FIG. 1, wherein the latter is set with the bottom wall 6 on a horizontal plane 9 (FIG. 1) is accordingly defined as the operating, or refilling, position of the station 1; according to this invention; in this position P1, the ink 17 occupies the collection chamber 18, to a pre-established level H with respect to the base 6, corresponding to a predetermined volume of ink, for instance 200 ml approximately, sufficient to completely refill the cartridge 2 several times.

In fact, according to the main object of the present invention, the cartridge 2, out of ink, is inserted in the housing 10 to be refilled with ink by means of the capillarity phenomenon, in which the ink 17 is transferred into the cartridge 2, solely and exclusively when the station 1 is arranged with the container 4 set with its base 6 on the horizontal plane 9, that is in the vertical position P1.

For this purpose, the cartridge 2 is provided at the bottom with un underframe 20, in which there is an aperture 22, through which the spongy body 14 faces the outside.

Refilling with ink between the collection chamber 18 and the cartridge 2 takes place through a capillary element 26, of a type known in the sector art, which is attached to the housing 10 and extends vertically inside the collection chamber 18.

The capillary element 26 is inserted in a pipe 24, in such a way as to leave protruding from the pipe an upper end 27 extending inside the housing 10 and a lower end 28, facing the base 6 of the container 4.

The pipe 24 is attached to the bottom wall 11 of the housing 10, in correspondence with the aperture 22 of the cartridge 2 and can be kept in position, for example, by a rubber collar 15, forced into an aperture 25 in the bottom wall 11; the pipe 24 extends perpendicularly to the bottom wall 6 of the container 4, to a distance of approximately 2-5 mm from it.

The pipe 24, according to a preferred embodiment (FIG. 5), is attached to the bottom wall 11 of the housing 10 by means of a blocking member 29, consisting of a cylindrical cover, mounted upside down to seal a boss 32, protruding from a bottom wall 11 of the housing 10; the cover 30 is provided with a hole 33 inside which the pipe 24 is rigidly attached.

The hydrostatic pressures inside the cartridge 2 and in the collection chamber 18 are reciprocally compensated by means of a compensating device 34, contained in the blocking member 29. The compensating device 34 comprises a flat, elastic lamina valve 36, which is attached compressed between a ring-like shoulder 37 of the cover 30 and the boss 32 of the bottom wall 11.

Figure 5:
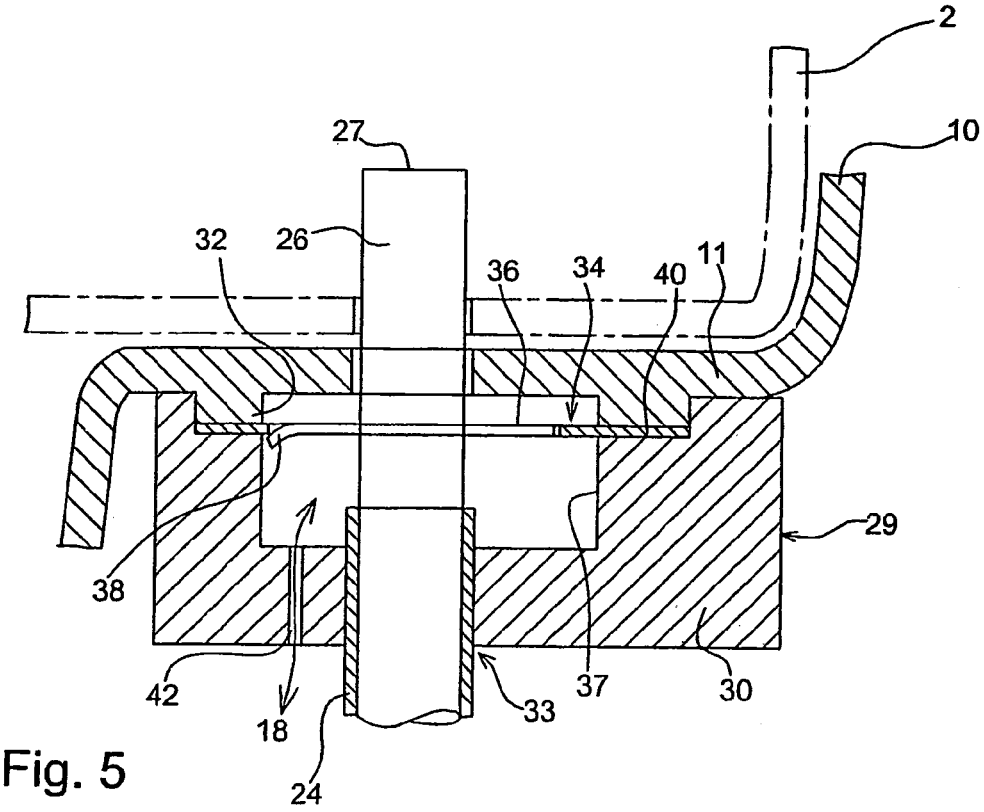
FIG. 5 is a construction detail of the hydrostatic pressure compensator.

The lamina 36 includes a flexible, central portion 38, joined with an external ring-like part 40 of the same lamina, through a small, radial leg member, not shown in FIG. 5; the central portion is suitable for elastically assuming one or the other of two positions, when it is urged by the difference in hydrostatic pressure between the cartridge 2 and the collection chamber 18: when there is no difference in pressure between cartridge 2 and collection chamber 18, the portion 38 remains in a position of equilibrium, coplanar with the ring-like part 40; when there is a difference in pressure between cartridge 2 and collection chamber 18, the portion 38 flexes elastically to one side or the other with respect to the equilibrium position, enabling air to pass from the cartridge 2 to the collection chamber 18, or vice versa, through a hole 42 made in the cover 30 and communicating with the collection chamber 18 (FIGS. 1 and 5).

Alternatively or in association with the use of the device 34, described above, compensation for differences in pressure between collection chamber 18 and cartridge 2 can also be provided by adopting a number of grooves 23 (FIG. 2) made inside the pipe 24.

According to a construction variant, the pipe 24 can be replaced by a rigid and impermeable sheath, surrounding the capillary element 26; according to this variant, the sheath containing the capillary element 26 is attached to the bottom wall 11 of the housing 10 by means of a plug of punctured elastic rubber, forced through the bottom wall 11.

The capillary element 26 is normally made from a preformed cylinder of spongy material, with communicating cells; alternatively, the capillary element 26 can be made of a bunch of fibres of synthetic or natural material, compressed longitudinally to form a cylindrical package suitable for being inserted in the pipe 24.

The collection chamber 18 communicates freely (FIG. 2) and continuously with a back-flow compartment 45, disposed in the top part of the container 4, adjacent to the top wall 7, and distributed all around the housing 10; the back-flow compartment 45 is sized such as to have a volume substantially at least equal to the volume of said predetermined quantity of ink 17 contained in the collection chamber 18; this solution, according to the invention, ensures that the cartridge 2 is fed, via the capillary element 26, solely and exclusively when the container 4 is in the vertical position on the support platform 9, and also means that ink running or leaking outside the container 4 can be avoided, when the container 4 is in positions other than the vertical.

In addition the back-flow compartment 45, the collection chamber 18 and the predetermined quantity of ink 17 have their respective volumes proportionate in such a way that the capillary element 26 remains uncovered by ink 17, when the container 4 is in any position other than the vertical operating position P1.

Figure 4:
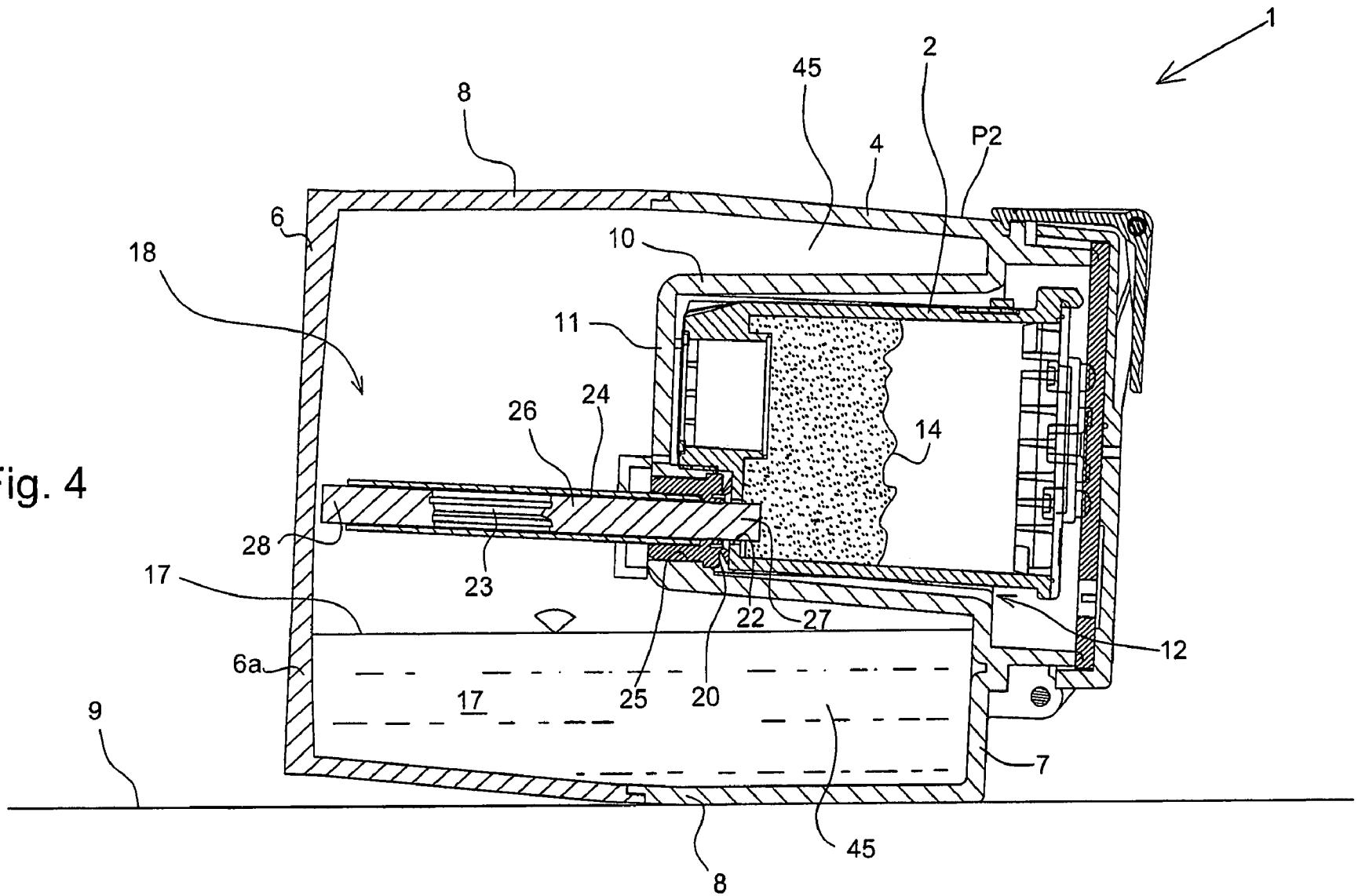
FIG. 4 represents a cross-sectioned view of the station of FIG. 2 set on one side.

Therefore when the container 4 is tilted on one side through at least 90° (position P2 in FIG. 4), the ink flows partially from the collection chamber 18 towards the back-flow compartment 45, and the ink remaining in the collection chamber 18 comes to a level where it does not lap against and therefore wet the capillary element 26, so that in this position P2 all risk of dripping is eliminated.

All the more so, when the container 4 is, for example, turned upside down, all the ink flows freely from the collection chamber 18 to the back-flow compartment 45, and accordingly the lower end 28 of the capillary element 26 is not covered by ink, thus in this position too, all risk of ink dripping from the upper end 27 inside the housing 10 is eliminated.

From the foregoing description, the advantages obtained from the station according to the present invention will be evident, with respect to similar solutions known in the state of the art, in that the station 1 described, by ensuring the feeding of the cartridge 2 solely and exclusively when the container 4 is in the vertical operating position P1, as defined above, avoids the ink being transferred through the capillary element 26, when the container 2 is placed on its side (FIG. 4), or turned upside down.

In fact, in any position of the container 4 other than the vertical, for instance during transport, the capillary element 26 is kept separate from the ink which flows into the back-flow compartment 45, and does not transfer ink, thus avoiding overfeeding of the cartridge 2, or leakage of ink inside the housing 10, when the cartridge 2 is missing.

It remains understood that changes may be made to the storage and ink refilling station, according to the invention, or parts substituted, without departing from the scope of the invention.

The invention claimed is:

1. A station for storing and refilling with ink a cartridge of a printhead having a spongy body to be refilled, comprising:

a container with a collection chamber defining a first volume, the collection chamber containing a predetermined quantity of ink for refilling completely the spongy body of said cartridge a plurality of times, said collection chamber being arranged adjacently to a bottom wall of said container, said bottom wall serving as a support platform for said container on a horizontal plane so as to define a vertical operating position of said station, said container having an external shape defining at least one side wall of said container and also being provided with a housing attached to a top wall of said container and suitable for accommodating said cartridge;

capillary refilling means having a first end at least partially immersed in said predetermined quantity of ink when said station is arranged in said vertical operating position, and a second end for extending inside the housing and suitable for cooperating with said cartridge for transferring by capillarity said ink from said collection chamber to said spongy body of said cartridge; and a back-flow compartment defining a second volume, the back-flow compartment surrounding said housing and communicating freely with said collection chamber for receiving the ink contained in said collection chamber when said station is turned on from said vertical operating position, wherein the second volume defined by the back-flow compartment is dimensioned and configured with respect to the first volume defined by the collection chamber such that, when said station is tilted from said vertical operating position and placed along any side wall of said container in a tilted position on said horizontal plane, or when said station is turned upside down with respect to said vertical operating position, a sufficient amount of said predetermined quantity of ink flows back from said collection chamber to said back-flow compartment to cause said first end of said capillary refilling means to emerge from said ink, whereby any leakage of ink through said second end of said capillary refilling means is avoided.

2. The station according to claim 1, wherein said second end is suitable for directly transferring by capillarity said ink from said collection chamber to said spongy body of said cartridge.

3. The station according to claim 2, wherein the second volume defined by said back-flow compartment is at least equal to a volume of said predetermined quantity of ink.

4. The station according to claim 2, wherein said capillary refilling means is disposed in a central position with respect to said bottom wall and symmetrical with respect to the side walls of said container.

5. The station according to claim 2, wherein said capillary refilling means comprises an elongated capillary element passing through a bottom wall of said housing and having a lower end facing said bottom wall and an upper end suitable for being inserted in said cartridge for transferring said ink through capillarity from said container to said cartridge.

6. The station according to claim 5, wherein said capillary element is inserted in an impermeable, tube-like element attached to said housing and extending in said collection chamber perpendicularly to said bottom wall, said tube-like element also being disposed in a position that is central with respect to said bottom wall and symmetrical with respect to the side walls of said container, so that said capillary element is not covered by said ink when said container is tilted laterally or turned upside down.

7. The station according to claim 6, wherein said tube-like element consists of a rigid pipe attached to said bottom wall of said housing.

8. The station according to claim 6, wherein said tube-like element consists of a rigid and impermeable sheath attached tightly to said bottom wall.

9. The station according to claim 5, wherein said lower end of said capillary element is placed at a distance of not more than about 5 cm from said bottom wall.

10. The station according to claim 2, wherein said container comprises a compensating device for balancing differences in hydrostatic pressure between said collection chamber and said cartridge, said compensating device comprising a lamina valve attached against a boss of the bottom wall of said housing, said lamina comprising a flexible portion suitable for elastically assuming one or the other of two positions at opposite ends with respect to a rest position, when said lamina is urged by the difference in hydrostatic pressure between the cartridge and the collection chamber or vice versa.

* * * * *